United States Patent [19]

Miller

[11] Patent Number: 4,999,888

[45] Date of Patent: Mar. 19, 1991

[54] SHOELACE RETAINER

[76] Inventor: Cathy S. Miller, 1123 Lausanne Avenue, Dallas, Tex. 75208

[21] Appl. No.: 471,776

[22] Filed: Jan. 29, 1990

[51] Int. Cl.[5] ..... F16G 11/00

[52] U.S. Cl. ..... 24/712.3; 24/306; 24/442

[58] Field of Search ..... 24/712.3, 712, 712.1, 24/712.2, 712.9, 17 AP, 30.5 P, 442, 306, DIG. 11; 36/50; 248/74.3; 2/DIG. 6, 245; 128/DIG. 15

[56] References Cited

U.S. PATENT DOCUMENTS

| | | | |
|---|---|---|---|
| D. 270,779 | 10/1983 | Steinberg | 24/306 |
| 1,549,170 | 8/1925 | Waldron | 128/DIG. 15 |
| 3,000,384 | 9/1961 | Piers, Jr. | 2/DIG. 6 |
| 3,106,003 | 10/1963 | Herdman | 24/712.3 |
| 3,146,778 | 9/1964 | Krawiec | 24/DIG. 11 |
| 3,155,096 | 11/1964 | Outwin | 128/DIG. 15 |
| 3,383,738 | 5/1968 | Fox et al. | 2/DIG. 6 |
| 3,473,198 | 10/1969 | Meier | 24/712.3 |
| 4,019,504 | 4/1977 | Sterling | 128/DIG. 15 |
| 4,213,548 | 7/1980 | Wood | 2/DIG. 6 |
| 4,273,130 | 6/1981 | Simpson | 24/306 |
| 4,291,439 | 9/1981 | Riti | 24/712.2 |
| 4,403,375 | 9/1983 | Blum | 24/712.2 |
| 4,553,293 | 11/1985 | Blum | 36/50 |
| 4,571,854 | 2/1986 | Edens | 24/712.3 |
| 4,766,682 | 8/1988 | Malloy, III | 36/50 |
| 4,780,936 | 11/1988 | Brecher | 24/306 |
| 4,879,787 | 11/1989 | Walls | 24/306 |

FOREIGN PATENT DOCUMENTS

| | | | |
|---|---|---|---|
| 1056063 | 2/1954 | France | 24/17 AP |
| 2375841 | 9/1978 | France | 36/50 |
| 271364 | 1/1951 | Switzerland | 24/712.6 |
| 4256 | 4/1903 | United Kingdom | 24/712.3 |
| 2067385 | 7/1981 | United Kingdom | 36/50 |

*Primary Examiner*—Victor N. Sakran
*Attorney, Agent, or Firm*—Dennis T. Griggs

[57] ABSTRACT

A shoelace retainer includes a flexible, elongated strap member having a plurality of hook fastener elements on one surface thereof and a plurality of complementary loop fastener elements on an opposite surface thereof. A tab member having an elongated slot is disposed at a first end of the strap member for attaching the strap member to the footwear. The free ends of the shoelace are passed through the slot and the ends are tied in a conventional bowknot. The bow loops and free ends of the shoelace are placed on top of the strap member and the strap member is rolled up and onto itself, whereby the hook fastener elements become interlocked with the loop fastener elements, thereby confining the bow loops and free ends between convoluted layers.

8 Claims, 3 Drawing Sheets

SHOELACE RETAINER

Field of the Invention

This invention relates generally to footwear and in particular to an improved shoelace retainer.

Background of the Invention

Flexible laces ar typically used to securely fasten shoes, sneakers and other footwear. After the lace is tightened on the footwear, the ends are usually tied in a conventional bowknot. It is well-known that such bowknots have a tendency to loosen or become untied, which is inconvenient and often hazardous, particularly when one is engaged in athletic activities.

Furthermore, children will frequently tug or trip on the ends of the laces, thereby loosening or untying the bowknot. This places a burden on parents and other adults charged with supervision of children to continually retie the shoelaces. To overcome this problem, a parent will often tie a double knot to make it more difficult for the child to loosen or untie the knot by pulling on the ends of the laces. This double knot is difficult to untie, even for an adult, when the adult wishes to remove the child's shoes.

Description of the Prior Art

Various retainer devices are known in the art to prevent shoelaces from becoming untied. Such retainer devices may include attachment members which adhere to the shoelaces themselves to exert tension thereon, such as the retainers shown in U.S. Pat. Nos. 4,247,967 and 4,428,101. Other retainer devices utilize attachment members which enclose the bowknot to prevent the loosening thereof, as shown in U.S. Pat. Nos. 4,780,936 and 4,553 293.

Although prior art shoelace retainers tend to impede the loosening of the bowknot, the ends of the laces are typically exposed, which permits a child to continue to tug on the laces, even after the retaining device is attached to the shoelace. Furthermore, the exposed loops and ends of the laces may be stepped upon, which can cause a person to trip, particularly when he is engaged in vigorous athletic activity Objects of the Invention It is therefore the principal object of the present invention to provide an improved shoelace retainer.

Another object of the present invention is to provide a shoelace retainer in which substantially the entire end portions of the shoelace are enveloped by the retainer.

Yet another object of the invention is to provide an improved shoelace retainer for impeding the loosening of a shoelace knot.

Summary of the Invention

These and other objects are accomplished in accordance with the present invention wherein a shoelace retainer is provided which includes a flexible strap with first and second attachment members disposed on respective opposite sides thereof. Means is provided for attaching the strap member to a shoe or other footwear, adjacent to the shoelace knot. The end portions of the shoelace emanating from the knot are placed on one side of the strap member and the strap member is rolled upwardly onto itself, such that the end portions of the shoelace are retained by the rolled strap member, to prevent the bowknot from becoming loosened or untied.

In one embodiment a tab member at one end of the strap member has an elongated, transverse notch for allowing the end portions of a shoelace to be routed therethrough before the bowknot is tied. When the bowknot is tied, the tab member will be retained by the knot, thereby securing the tab member and strap member to the footwear. In another embodiment the first attachment member is comprised of two spaced-apart, substantially parallel strips of material. The end portions of the shoelac emanating from the bowknot are positioned between the strips and the strap member is rolled up and onto itself to substantially completely envelope the end portions of the shoelace.

In the preferred embodiment, the first attachment member is a strip of hook fasteners and the second attachment member is a strip complementary loop fasteners. When the strap member is rolled onto itself, the hook fasteners will be intermeshed with the loop fasteners to hold the strap member in a rolled-up configuration. When the strap member is in the rolled-up configuration, the loop fasteners will be exposed, to provide a relatively soft outside surface on the rolled strap member.

The novel features which characterize the invention are defined by the appended claims. The foregoing and other objects, advantages and features of the invention will hereinafter appear, and for purposes of illustration of the invention, but not of limitation, exemplary embodiments are shown in the appended drawings.

Detailed Description of the Preferred Embodiment

Figure 1:
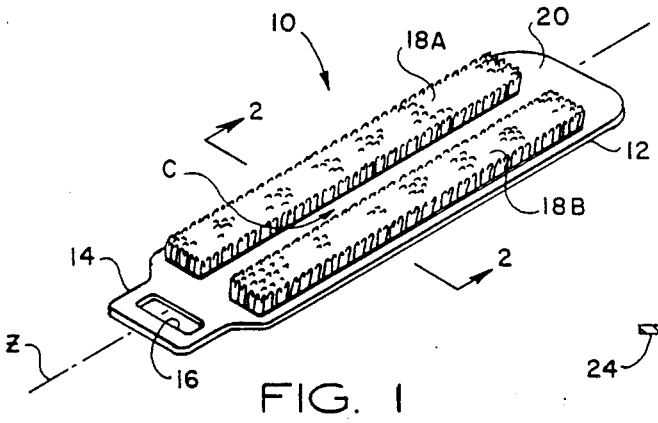
FIG. 1 is a perspective view of a shoelace retainer according to the present invention.

In the description which follows, like parts are indicated throughout the specification and drawings with the same reference numerals, respectively. The drawings are not necessarily to scale and the proportions of certain parts have been exaggerated to better illustrate details of the present invention.

Figure 2:
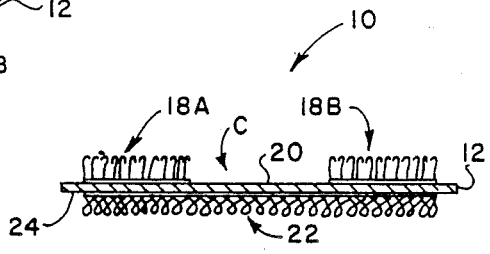
FIG. 2 is a sectional view of the shoelace retainer of FIG. 1, taken along the line 2—2 of FIG. 1.

Referring to FIGS. 1 and 2, a shoelace retainer 10 according to the present invention includes an elongated flexible strap 12 and a tab 14 integrally formed at one end of the strap 12. The tab 14 is of generally rectangular shape and has an elongated, transverse slot 16 centrally disposed therein. The strap 12 is in the shape of a rectangle with generally rounded corners. Both the strap 12 and the tab 14 are preferably of a lightweight, but durable synthetic material, such as the material sold by E. I. duPont de Nemours Corporation under the trademark "NYLON". The strap member 12 has a plurality of hook elements 18 projecting from a first major surface 20 thereof. The hook elements 18 are made of a flexible monofilament material and are arranged in two laterally spaced strips 18A, 18B which extend substantially the entire length of strap 12 in alignment with the longitudinal axis Z of the strap 12.

The laterally spaced fastener strips 18A, 18B are separated by a channel slot C for receiving the bow loops and free end portions of a shoelace. The strap 12 further includes a strip of loop elements 22 on the opposite side surface 24 thereof. The loop elements 22 are arranged in a substantially uniform pile fabric face on the opposite side surface 24 for mesh engagement with the hook elements 18, as will be described in greater detail hereinafter. The hook elements 18 and loop elements 22 are preferably of the type manufactured and sold by Velcro Corporation of New York, N.Y. under the trademark "VELCRO".

Figure 3:
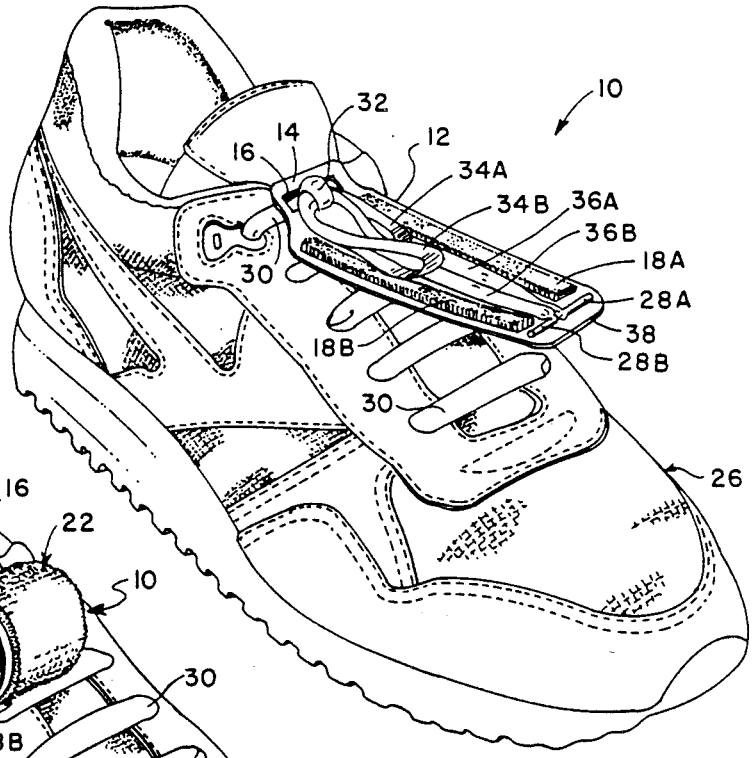
FIG. 3 is a perspective view of an athletic shoe, with the shoelace retainer of FIG. 1 attached thereto in an unrolled configuration.
Figure 4:
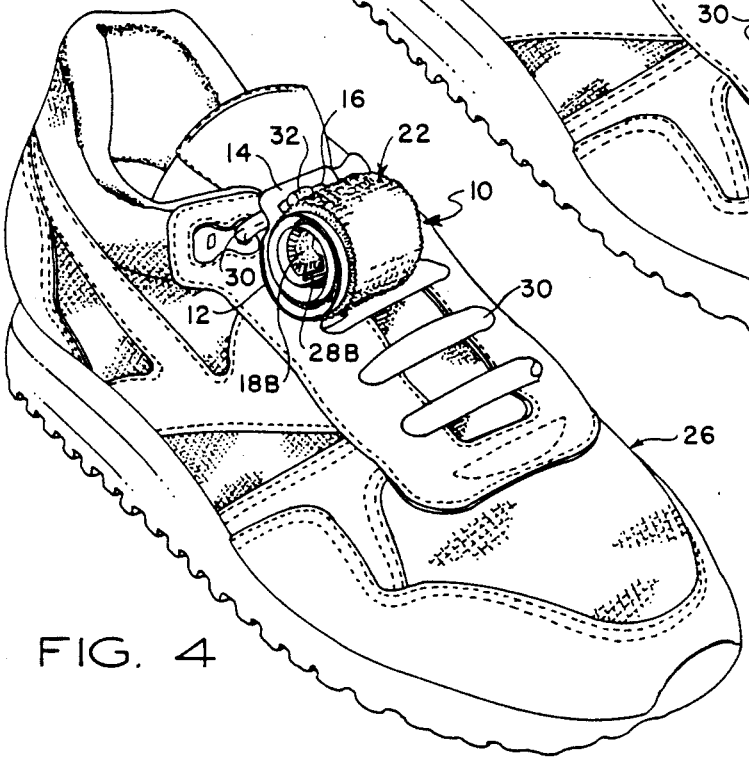
FIG. 4 is a perspective view of the athletic shoe of FIG. 3, with the shoelace retainer in a rolled-up configuration.
Figure 5:
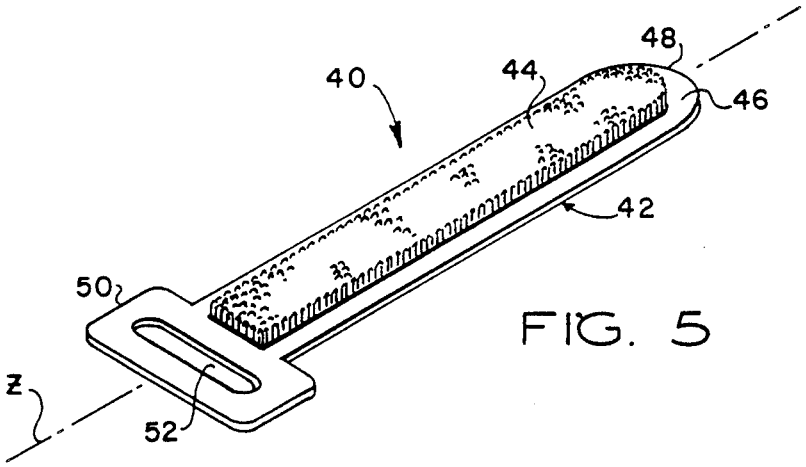
FIG. 5 is a perspective view of an alternate embodiment of a shoelace retainer according to the present invention.

Referring to FIGS. 3 and 4, shoelace retainer 10 is attached to footwear, such as an athletic shoe 26 by passing the free ends 28 of shoelace 30 through slot 16 and then tying a conventional bowknot 32, whereby tab 14 is disposed beneath knot 32, as shown in FIG. 3. After bowknot 32 is tied, the end portions of shoelace 30 are defined by two loops 34A, 34B, two free end portions 36A, 36B, and terminal end portions 28A, 28B, which emanate from the knot 32.

To prevent the knot 32 from being loosened or untied, the free ends 36A, 36B are dressed along and about the channel slot C between the two strips 18A, 18B of hook elements 18. The respective terminal ends 28A, 28B thereof are turned outwardly, as shown in FIG. 3, so that the free ends 36A, 36B are confined within the perimeter of strap 12. Similarly, the loops 34 are oriented longitudinally along strap 12, so that the loops 34 are also confined within the perimeter of the strap 12.

After the loops 34A, 34B and cords 36 are positioned as shown in FIG. 3, strap 12 is rolled upwardly and convoluted onto itself, beginning at distal end 38 thereof, thereby capturing loops 34A, 34B and the free ends 36A, 36B between the convoluted layers. When the strap 12 is rolled up and onto itself, the hook elements 18 become releasably intermeshed and interlocked with the complementary loop elements 22 thereby providing a secure bond, but which can be readily separated by unrolling strap 12.

FIG. 4 shows the shoelace retainer 10 in its operative position, with the strap 12 in a rolled-up configuration and the loops 34A, 34B and the free ends 36A, 36B being substantially completely enclosed therein. When the strap 12 is in the rolledup configuration, the loop fastener strip 22 defines an outer surface of the strap 12. It is preferable to have the loop elements 22 on the outer surface because the loop elements 22 will provide a softer outer surface than the hook elements 18 on first major surface 20. Because the loops 34 and the free ends 36A, 36B are not exposed, it is difficult to loosen or untie the knot 32 without first unrolling strap 12. Furthermore, by confining the loops 34A, 34B and free ends 36A, 36B within the strap 12, the wearer is not likely to trip over the end portions of shoelace 30 or otherwise contact the free end portions.

Referring now to FIGS. 5–8, according to an alternate embodiment a shoelace retainer 40 includes a strap member 42, which has a single strip of hook elements 44 on a first major side surface 46 thereof. Consequently, the strap member 42 may be narrower than the strap 12, described above with reference to FIGS. 1–4. The strap member 42 is substantially rectangular with a rounded distal end 48. A substantially rectangular tab member 50 is integrally formed at an opposite end of the strap member 42 and includes an elongated, transverse slot 52 for receiving the terminal ends 54A, 54B of the shoelace 56 therethrough, as previously described, to attach the shoelace retainer 40 to footwear.

Figure 6:
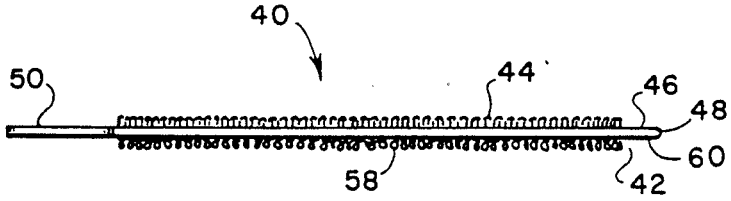
FIG. 6 is a side elevation view of the shoelace retainer of FIG. 5.
Figure 7:
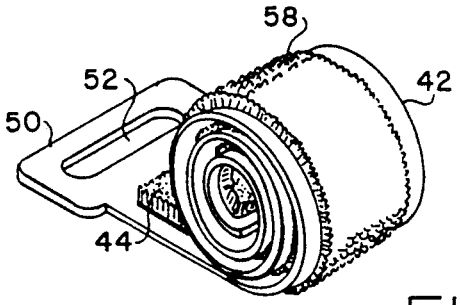
FIG. 7 is a perspective view of the shoelace retainer of FIG. 5 in a rolled-up configuration.
Figure 8:
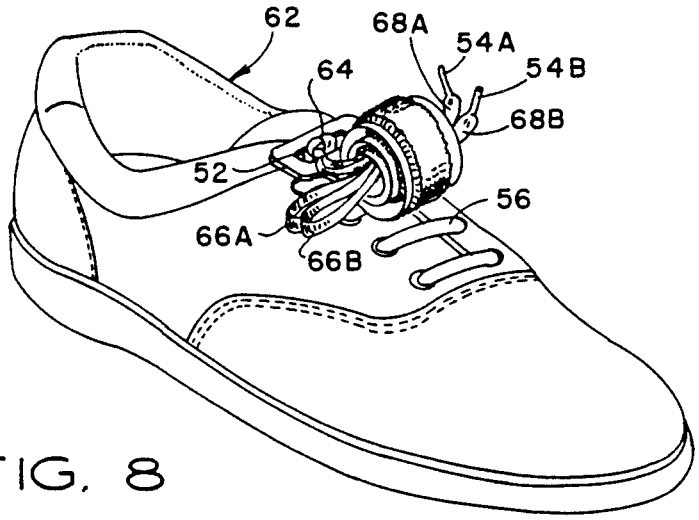
FIG. 8 is a perspective view of a shoe, with the shoelace retainer of FIG. 5 attached thereto in the rolled up configuration.

As best seen in FIG. 6, a plurality of loop elements 58 are disposed on the opposite side surface 60 of the strap member 42. As shown in FIG. 8, shoelace retainer 40 is attached to a shoe 62 by passing the free ends 54A, 54B of shoelace 56 through slot 52 and then tying a conventional bowknot 64, so that only the loops 66A, 66B and end portions 68A, 68B of the shoelace 56 are exposed. Instead of positioning the loops and terminal end portions longitudinally on the strap member 42, the two loops 66A, 66B are positioned in crossing relationship with the two free end portions 68A, 68B, so that both loops 66A, 66B and end portions 68A, 68B project beyond the perimeter of strap member 42. The strap member 42 is then rolled upwardly and onto itself, beginning at distal end 48, in substantially the same manner as previously described with respect to strap member 12.

When the strap member 42 is in a rolled-up configuration as shown in FIG. 8, the loops 66A, 66B and end portions 68A, 68B will project outwardly from the strap member 42 in substantially opposite directions. Furthermore, when the strap member 42 is in the rolled-up configuration, the second major surface 60 with loop elements 58 disposed thereon will provide a soft outer surface on the strap member 42.

Figure 9:
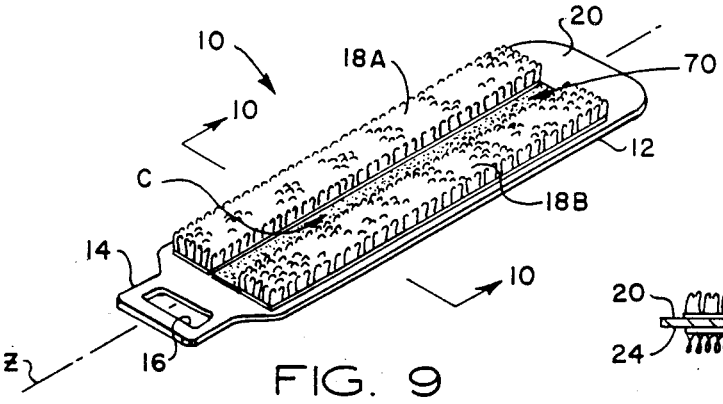
FIG. 9 is a perspective view of the shoelace retainer of FIG. 1 which has been modified with an adhesive strip.
Figure 10:
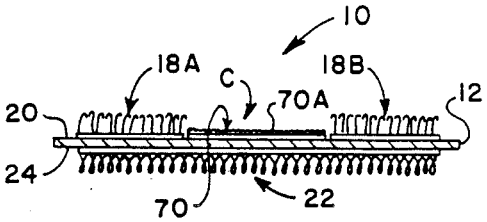
FIG. 10 is a sectional view of the shoelace retainer of FIG. 9, taken along the line 10—10 of FIG. 9.

Referring now to FIGS. 9 and 10, operation of the shoelace retainer 10 is enhanced by an adhesive strip 70 which is secured onto the strap 12 in the channel C between the fastener strips 18A, 18B. The purpose of the adhesive strip 70 is to assist the user in dressing the free end portions 36A, 36B and retaining them within the channel C, substantially as shown in FIG. 3. Preferably, the adhesive strip 70 comprises a pressure sensitive, adhesive deposit 70A which is adherable to natural fiber and synthetic fabrics.

Figure 11:
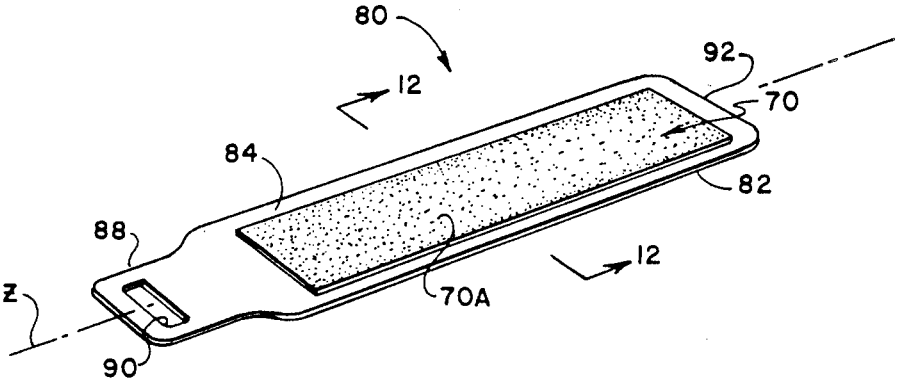
FIG. 11 is a perspective view of a shoelace retainer constructed according to an alternative embodiment of the present invention.
Figure 12:
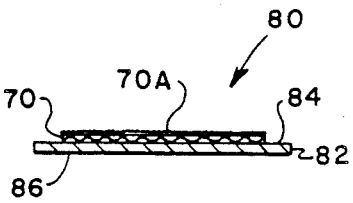
FIG. 12 is a sectional view of the shoelace retainer of FIG. 11, taken along the line 12—12 of FIG. 11

Referring now to FIGS. 11 and 12, according to another alternative embodiment, a shoelace retainer 80 includes a strap member 82, which has an adhesive strip 70 secured onto a first major side surface 84. The adhesive strip 70 includes an adhesive deposit 70A which is adherable to natural fiber and synthetic fabric materials, such as Nylon polymer fabric. According to this embodiment, the adhesive deposit 70A is made of a pressure sensitive polymer adhesive material. Because the adhesive fastener strip 70 is secured onto only one side surface 84, the strap member 82 may be narrower than the strap 12 of the shoelace retainer 10, described above with reference to FIGS. 1–4 and FIGS. 9, 10. The strap member 82 includes a rectangular tab member 88 which is integrally formed at one end and includes an elongated, transverse slot 90 for receiving the terminal end portions 54A, 54B of the shoelace 56, as previously described, to attach the shoelace retainer 80 to footwear.

Figure 13:
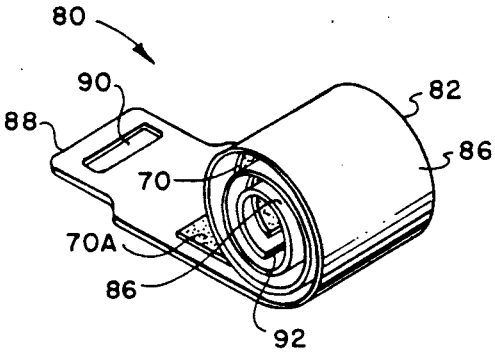
FIG. 13 is a perspective view of the shoelace retainer of FIG. 11 in a rolled up configuration.

In the arrangement shown in FIGS. 11-13, the shoelace end portions are preferably positioned onto the adhesive strip 70 in crossing relationship with the free end portions projecting beyond the perimeter of the strap member 82. The strap member 82 is then rolled onto itself, beginning at the distal end 92, with the opposite side surface 86 being adhered to the adhesive deposit 70A. The shoelace end portions are captured and confined as the strap 82 is rolled upwardly and convoluted onto itself. The opposite side surface 86 presents a smooth outer surface in the rolled-up configuration as shown in FIG. 13

The shoelace retainer of the present invention provides a distinct advantage over prior art shoelace retainers because the shoelace end portions emanating from the knot can be substantially confined, to impede the loosening and untying of the knot and to prevent the end portions from interfering with the wearer's activities. Furthermore, the rolled-up configuration of the shoelace retainer according to the present invention is less likely to become disengaged accidentally or by unwanted tampering, such as by a child, as compared with prior art configurations in which the shoelace retainer is secured between sharp metal teeth or spring loaded fasteners.

Although the invention has been described with reference to a specific embodiment, the foregoing description is not intended to be construed in a limiting sense. Various modifications to the disclosed embodiment as well as alternative applications of the invention will be suggested to persons skilled in the art by the foregoing specification and illustrations. It is therefore contemplated that the appended claims will cover any such modifications, applications or embodiments as fall within the true scope of the invention.

What is claimed is:

1. A shoelace retainer for securing the free ends of a shoelace comprising, in combination:

flexible strap member;

a tab member disposed at a first end of said strap member for attaching said strap member to footwear, said tab member having a slot for receiving respective free ends of the shoelace, such that the tab member is mountable under the knot to retain the tab member and strap member on the footwear;

a plurality of hook fastener members secured onto a first major surface of said strap member; and, a plurality of loop fasteners secured onto a second major surface of said strap member, said loop fasteners being complementary with said hook fasteners and adapted for intermeshed engagement with said hook fasteners when said strap member is rolled onto itself along the longitudinal axis of said strap.

2. A shoelace retainer as defined in claim 1, wherein the fastener elements on one side of said strap are divided into first and second strips of hook fastener elements, said first and second fastener strips being laterally spaced apart thereby defining a longitudinal channel therebetween.

3. A shoelace retainer as defined in claim 1, including a strip of pressure sensitive adhesive disposed onto said flexible strap member, said shoelace free ends being adherable to the pressure sensitive adhesive strip.

4. A shoelace retainer for securing the free ends of a shoelace knot comprising, in combination:

a flexible strap member having first and second side surfaces and a first end portion;

a tab member disposed on the fist end portion of said strap member for attaching said strap member to footwear, said tab member having a slot for receiving respective free ends of the shoelace, such that the tab member is mountable under the knot to retain the tab member and strap member on the footwear;

a strip of adhesive material disposed on the first side surface of said flexible strap member; and, the second side surface of said flexible strap member being adherable to said adhesive strip when said strap member is rolled onto itself with the second side surface being disposed in convoluted engagement with the adhesive strip.

5. A method of retaining shoelace end portions comprising the steps:

providing a flexible strap member having a first fastener member disposed on a first side surface thereof and a second fastener member disposed on a second side surface thereof, said first and said second fastener members being adapted for mutually contacting, interlocking engagement when said first and second fastener members are in contact;

securing a tab member onto a first end portion of the strap member, said tab member having an elongated slot therein;

passing respective free end portions of the shoelaces through the elongated slot and tying the ends of the shoelaces to form a knot, whereby said tab member is disposed under said knot for retaining said tab member and said strap member onto said footwear;

dressing said shoelace end portions about one side surface of said strap; and, rolling said strap member onto itself with said shoelace end portions being rolled and confined between said first and second fastener members.

6. The method as defined in claim 5, wherein said first fastener member is comprised of first and second spacedapart strips of fastener elements, said method further including the step of dressing the free end portions of the shoelace emanating from the knot along the strap member between the spaced strips of fastener elements prior to rolling said strap member, whereby the dressed portions of said shoelaces are confined between the rolled portions of said strap member when said strap member is in the rolled-up configuration.

7. The method as defined in claim 5, wherein said knot is a bowknot having a pair of loops and a pair of terminal end portions emanating therefrom, including the step of crossing said loops and said terminal end portions about one side of said strap member prior to performing said rolling step.

8. A method of retaining the free ends of a shoelace comprising the steps:

providing a flexible strap member having an adhesive strip disposed on a first side surface thereof, said adhesive strip and said second side surface being adapted for adhering engagement when said second side surface is brought into pressure contact engagement with said adhesive strip;

securing a tab member onto an end portion of the strap member, said tab member having an elongated slot therein;

passing respective free ends of the shoelace through the elongated slot and typing the ends of the shoelace to form a knot, whereby said tab member is disposed under said knot for retaining said tab member and said strap member onto said footwear;

dressing said shoelace end portions about said adhesive strip; and, rolling said strap member onto itself with said shoelace end portions being rolled and confined between said adhesive strap and said second side surface of said strap.

* * * * *